United States Patent [19]

Fishman

[11] 4,345,407

[45] Aug. 24, 1982

[54] MULTI-UNIT DWELLINGS

[76] Inventor: Maurice J. Fishman, 2751 S. Ocean Dr., Apt. #PH8 S. Tower, Hollywood, Fla. 33019

[21] Appl. No.: 155,503

[22] Filed: Jun. 2, 1980

[51] Int. Cl.[3] ..... E04H 1/04

[52] U.S. Cl. ..... 52/169.3; 52/234; 52/236.3

[58] Field of Search ..... 52/234, 236.3, 236.5, 52/169.3, 205; 187/1 R, 3

[56] References Cited

U.S. PATENT DOCUMENTS

| | | | |
|---|---|---|---|
| 1,997,060 | 4/1935 | Hirshfeld | 187/3 |
| 2,638,635 | 5/1953 | Priebe | 52/205 |
| 4,007,565 | 2/1977 | Finnegan | 52/169.3 |

OTHER PUBLICATIONS

Progressive Architecture, Aug. of 1964, pp. 121, 133 and 134.

*Primary Examiner*—James L. Ridgill, Jr.

[57] ABSTRACT

A multi-unit dwelling having individual living units therein which have main living areas protected from noise and visual pollution and which are arranged to afford maximum privacy to each living unit. The multi-unit dwelling includes a plurality of contiguous living units arranged to form a courtyard enclosed on at least three sides there between which is protected from noise and visual pollution by the plurality living units. Each of the living units includes a court side exposed to said courtyard and a service side exposed to vehicle access and the associated noise and visual pollution associated with vehicles. Each living unit includes a living area and a bedroom area disposed on the court side of the living unit and a bathroom, a utility room, storage areas, a garage, and a main private entrance way disposed on said service side of said living unit. The living area and bedroom area each include windows therein exposed to said protected courtyard and the bathroom, utility room, garage and storage area form a buffer for noise and visual pollution between the service side of the living unit and the living area and bedroom area. The garage of each of the living units includes a vehicle entrance therein opening to the service side of each living unit and a garage private entrance way from the garage to the associated living unit.

11 Claims, 4 Drawing Figures

MULTI-UNIT DWELLINGS

FIELD OF THE INVENTION

The present invention relates to a multi-unit dwelling structure and more particularly to a multi-unit dwelling structure including a plurality of contiguous living units arranged to form a courtyard and wherein the individual living units include living areas and bedroom areas which are protected from noise and visual pollution to afford maximum privacy to the living areas and bedroom areas of each living unit.

BACKGROUND OF THE INVENTION

Numerous attempts have been made to develop multi-unit housing wherein each individual living unit is protected from noise and visual pollution. Such attempts are exemplified by the following patents–Samaha, U.S. Pat. No. 1,477,451; Earle, U.S. Pat. No. 1,654,683; Van Der Lely, U.S. Pat. No. 3,254,458; Johnson, U.S. Pat. No. 3,479,781; Jenn, U.S. Pat. No. 3,629,983; Stoop, U.S. Pat. No. 3,720,023; Gentry, U.S. Pat. No. 3,874,137; Coxe, U.S. Pat. No. 3,996,709 and Finnegan, U.S. Pat. No. 4,007,565. The Samaha, Van Der Lely, Johnson and Jenn patents all are directed to housing including inner courtyards. Johnson even discloses private garages. Stoop, Gentry and Coxe all dispose complex of houses wherein patios or private courtyards are provided. However, none of the prior art discloses multiple housing units wherein vehicle traffic is kept on one side, a quiet courtyard is provided on the opposite side and the rooms are arranged in the individual units with the living area and bedroom area contiguous to the inner courtyard side and the service areas of the living unit disposed contiguous to the vehicle or service side of the building to provide noise and pollution control and wherein a private garage is provided for each living unit.

SUMMARY OF THE PRESENT INVENTION

The present invention provides a new and improved multi-unit dwelling structure wherein vehicle traffic is kept on one side of the multi-unit dwelling and an inner courtyard is formed from a plurality of contiguous living units and the rooms of the individual living units are arranged such that the living areas and bedroom areas face the courtyard while the storage and service areas provide a buffer for noise and visual pollution between the service side of the unit and the living and bedroom areas of the unit.

Another provision of the present invention is to provide a multi-unit dwelling having individual living units therein which are protected from noise and visual pollution and which are arranged to afford maximum privacy to each living unit including a plurality of contiguous living units arranged to form a courtyard enclosed on at least three sides there between which is protected from noise and visual pollution by the plurality of living units. Each of the living units includes a court side exposed to the courtyard and a service side exposed to vehicle access and the associated noise and visual pollutions associated with vehicles. Each of the living units includes a living area and a bedroom area disposed on the court side of the living unit and a bathroom, utility room, storage areas, garage, and main private entrance way disposed on the service side of the living unit. The living area and bedroom area each includes windows exposed to the protected courtyard and the bathroom, utility room, garage and storage area form a buffer for noise and visual pollution between the service side of the living unit and the living and bedroom areas. A private garage is provided for each of the living units and includes a vehicle entrance therein opening to the service side of the living unit and a garage private entrance way from the garage to the associated living unit.

DESCRIPTION OF THE PREFERRED EMBODIMENT

Figure 1:
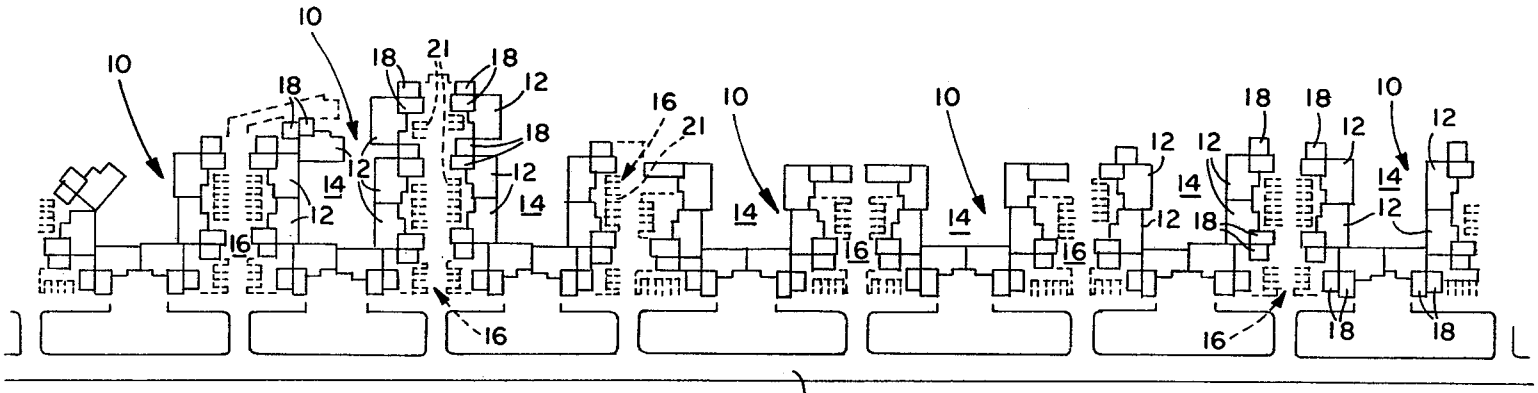
FIG. 1 is a schematic view of a plurality of multi-unit dwellings arranged to form a residential complex.

Referring to the figures and more particularly to FIG. 1, a plurality of multi-unit dwellings 10 are illustrated. Each of the multi-unit dwellings 10 includes a plurality of contiguous individual living units 12. The plurality of individual living units 12 of each multi-unit dwelling 10 form a courtyard 14 there between. Vehiclar access is provided from a roadway 17 to each of the dwelling units 12 via service areas generally designated 16. The service areas 16 are isolated from the courtyard 14 by the individual living units 12. Thus, the courtyard 14 provides a relatively quiet area which is accessible to each dwelling unit 12 and which is protected from the visual and noise pollution associated with the service areas 16. While the inner courtyard 14 has been illustrated as being substantially surrounded on three sides by the individual living units 12 of each multi-unit dwelling 10 it should be appreciated that the courtyard 14 could be surrounded on four sides rather than three sides, by the individual living units 12 to thereby form a completely enclosed courtyard 14 rather than the U-shaped or three-sided courtyard illustrated in the figures.

Figure 2:
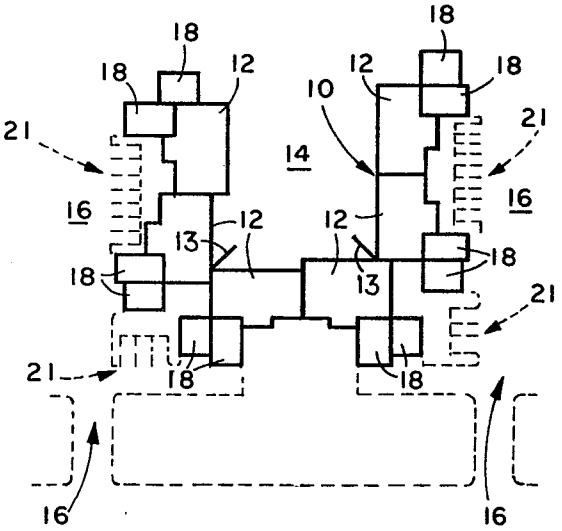
FIG. 2 is a schematic view of a single multi-unit dwelling showing the general arrangement of the plurality of individual living units located therein.

Referring to FIG. 2, a single multi-family unit dwelling 10 is more fully illustrated. The multi-unit dwelling 10 is U-shaped in configuration and is surrounded on three sides by service areas 16. The service areas 16 allow vehicle access to each of the individual living units 12. Each of the individual living units 12 includes a private attached garage 18 associated therewith, more fully described herein below, and additional parking areas 21 are disposed around the service side of the living units 12 to provide for additional parking for guests, deliveries and other types of services. The parking areas 21 and garages 18 are isolated from the courtyard 14 by the individual living units 12 to thereby buffer the courtyard from noise and visual pollution associated with vehicles and service activities.

Figure 3:
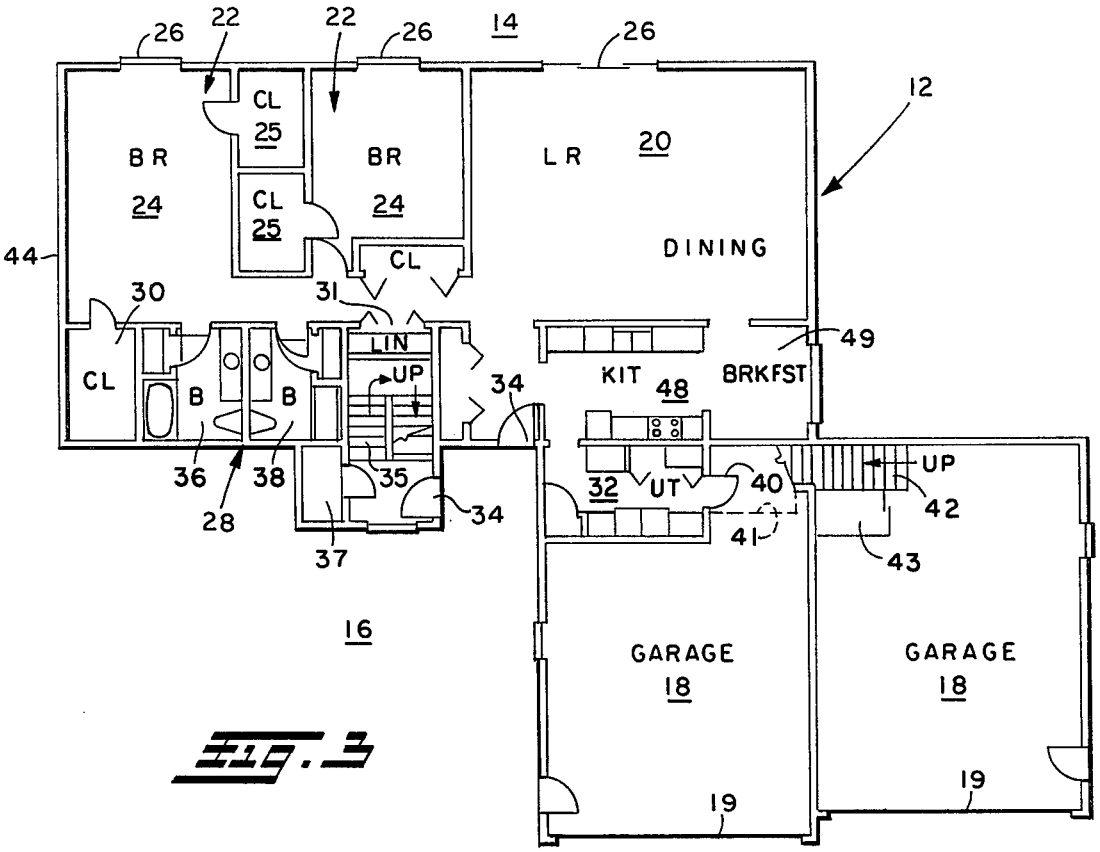
FIG. 3 is a schematic view of the floor plan of a typical living unit.

FIG. 3 illustrates a typical living unit 12 of a multi-unit dwelling 10. Each of the living units 12 are located on a single floor level. While each individual living unit is disposed on a single floor level, all of the living units 12 are not necessarily disposed on the same floor level. A second story can be disposed above the first story of the multi-unit dwelling 10 and may include a plurality of living units 12 substantially identical to the living units 12 disposed on the first floor levels. The living units 12 disposed on the second story, of the multi-unit living unit 10 also provide for single floor living as will be described more fully hereinafter.

Each of the living units 12 includes a living area 20 and a bedroom area 22 which in the preferred embodiment in FIG. 3 includes a pair of bedrooms 24 having closets 25 associated therewith. The living area 20 can include a dining area or a family room area therein. The living area 20 and the bedroom area 22 are disposed on the court side of the living unit 12 and each include windows 26 which are exposed to the courtyard 14. Thus, it should be appreciated that the windows 26 will provide the users of each living unit 12 with a serene view of the courtyard 14 which is protected from noise and visual pollution.

Each of the living units 12 also include a bathroom area 28, a storage area 30, a utility room 32 and a main entrance way 34 which are disposed on the service side 16 of the unit 12. In addition, a private garage 18 for each unit 12 is also located on the service side 16 of the unit 12. The bath area 28, in the present embodiment illustrated in FIG. 3, includes a pair of bathrooms 36 and 38. The storage area 30, the bathroom area 28, the utility room 32 and the garage 18 provide a buffer between the service areas 16 and the living area 20 and the bedroom area 22. Thus, the main living area 20 and bedroom areas 22 of each individual living unit 12 are protected from the noise and visual pollution associated with the service side of the unit by the location of the bath area 28, storage area 30, utility room 32 and garage 18. Preferably, the bath area 28, closet area 30 and utility room 32 are windowless to increase the effectiveness of these rooms as a buffer area for the bedroom area 22 and living area 20. The closet area 30 may also include a linen closet 31.

A kitchen 48 is provided in each unit 12 interposed between the service side of the unit and the living area 20. While the kitchen 48 has been disposed contiguous to the utility room 32, as illustrated in FIG. 3, it should be apparent that the kitchen location could be varied. However, it is important that the kitchen act as a buffer between the service side of the unit and the living area 20. The kitchen 48 may also include a breakfast or eating area 49 contiguous therewith.

The garage 18 of each unit 12 is disposed on the first floor level and is provided with a private entrance way 40 from the garage 18 to its associated living unit 12 and a private vehicle entrance 19 from the service side of the unit to the interior of the garage 18. The private garage entrance 40 allows a user of the unit 12 to go directly from the unit 12 through the door 40 to the interior of the garage 18 associated with the unit 12. The garages 18 associated with the second floor units, which are disposed immediately above the first floor units are provided with a stairway 42 to provide direct access from the garage 18 associated with the second floor unit 12 to the second floor unit associated therewith. A suitable door, not illustrated, is provided at the top of the stairway 42 to provide a private garage access to the second floor unit, not illustrated. A suitable hallway or storage area, illustrated by phantom lines 41, is associated with the second floor unit 12 and connects the garage entrance way 40 of second floor unit 12 with the top of the stairs 42. A private elevator 43 may be located in the garage 18 associated with the second floor living units to provide access to the garage entrance way 40 of the second floor living units for the disabled or infirmed.

The second floor living units 12 are substantially identical to the first floor living units 12 except for the entrance ways thereto. As stated hereinabove, a stairway 42 is provided from the garage 18 of the second floor living units 12 to provide access thereto. In addition a stairway 35 is provided to provide access to the second floor living units 12 from their main entrance way 34. A suitable closet or storage area 37 may be provided at the top of the stairway 35 associated with the second floor living unit 12.

Each unit 12 includes vertical walls 44 which are disposed contiguous to adjacent living units 12. There vertical walls 44 are soundproofed to provide privacy for each of the individual units 12. In addition the horizontal floors and ceilings of the units 12 are soundproofed to isolate the first floor units 12 from the second floor units 12.

Figure 4:
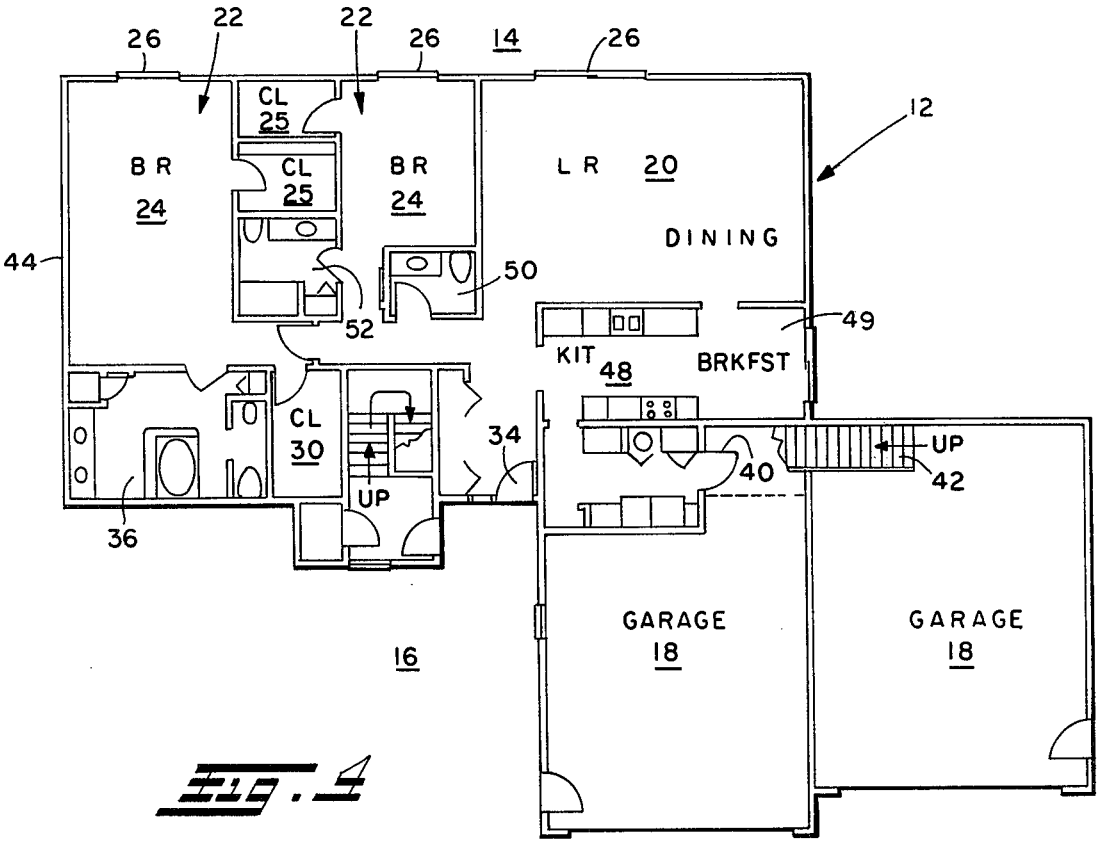
FIG. 4 is a schematic view of the floor plan of another typical living unit and further showing a portion of the adjacent corner unit and privacy screen.

A privacy screen 13, as illustrated in FIGS. 2 and 4, may be provided to prevent adjacent corner units from viewing from one corner unit 12 to the adjacent corner unit 12. The privacy screen 13 further enhances the privacy of the corner units as perceived from the interior thereof. The privacy screen may be a wall 13 as illustrated, or part of the terrace adjacent the units 12. Preferably the screen 13 extends at approximately a 45° angle from each of the corner units 12, as is illustrated in FIG. 2 to promote maximum privacy to the corner units.

It should be apparent that the present arrangements of living units 12 in a mult-family dwelling 10 includes many of the advantages of a single family home while eliminating the high cost of land normally associated with a single family home. By utilizing cluster dwelling units 12, more units per acre can be built while maintaining a higher degree of privacy and lower visual and noise pollution than associated with a single family home. Each unit 12 includes its own private front entrance 34 and its own private attached garage 18. Moreover, each garage 18 includes its own private entrance way 40 to its associated dwelling unit 12. In addition each unit 12 includes a living area 20 and a bedroom area 22 which overlooks a landscaped courtyard 14 which is open for purposes of relaxation or recreational use much in the manner that a rear yard is enjoyed by a standard single home. Additionally, the arrangement of the units block out noise and pollution especially that from vehicle traffic from the main living area 20 and the bedroom area 22.

Because the structure is so successful in blocking noise and visual pollution associated with vehicular traffic it can be utilized successfully in high vehicle traffic areas where single family residences are desired by local communities but are unsaleable or saleable only at substantially reduced prices due to the high traffic.

Another arrangement of a preferred embodiment of the invention is illustrated in FIG. 4 which illustrates a slightly different floor plan for the living unit 12. In the alternate embodiment illustrated in FIG. 4 like areas are illustrated with like numerals. In the embodiment illustrated in FIG. 4 additional bathrooms 50, 52 are provided and the arrangement of the closets 25 have been slightly modified. However, the concept in arranging the unit 12 is identical to that described hereinbefore. Specifically, the unit 12, illustrated in FIG. 4, includes a bath 36, a closet or storage area 30, a main entrance way 34, a utility room 32 and a garage 18 all disposed on the service side 16 of the unit 12 and a bedroom area 22, including bedrooms 24, and living area 20 are located on the courtside of the unit 12 and include a plurality of windows 26 exposed to the courtside 14. It should be apparent that further modifications and various arrangements of the rooms of the units 12 could be had without departing from the scope of the present invention.

From the foregoing it should be apparent that a new and improved multi-unit dwelling structure having individual units therein which are protected from noise and visual pollution and which are arranged to afford maximum privacy to each living unit has been provided. The multi-unit dwelling 10 includes a plurality of contiguous living units 12 arranged to form a court yard 14 enclosed on at least three sides there between which is protected from noise and visual pollution by the plurality of living units 12. Each of the living units 12 includes a court side exposed to the courtyard 14 and a service side exposed to the service areas 16 and each of the living units include a living area 20 and a bedroom area 22 disposed on the courtside of the living unit and a bathroom 36, a utility room 32, storage areas 30, a garage 18 and a main private entrance way 34 disposed on the service side of the living unit 12. The living area 20 and the bedroom area 24 each include windows 36 therein exposed to the protected courtyard 14 and the bathroom 36, utility room 32, garage 18 and storage areas 30 form a buffer for noise and visual pollution between the service side of the living unit 12 and the living area 20 and bedroom area 22. Each garage of each living unit 12 includes a vehicle entrance 19 therein opening to the service side of the living unit and a garage private entrance 40 from the garage to the associated living unit 12.

What I claim is:

1. A multi-unit dwelling having a plurality of individual living units therein which are protected from noise and visual pollution and which are arranged to afford maximum privacy to each living unit comprising, a plurality of contiguous single floor living units arranged to form a courtyard enclosed on at least three sides therebetween, said courtyard being protected from noise and visual pollution by the plurality of living units, said plurality of living units physically separating said service side and said vehicles associated therewith from said courtyard, each of said living units having a court side exposed to said courtyard and a service side exposed to vehicle access and the associated noise and pollution associated with vehicles, each of said living units including on a single floor level a living area and a bedroom area disposed on said court side of said living unit and a bathroom, a utility room, storage areas, a garage, and a main private entrance way disposed on said service side of said living unit, each of said living units further including a garage disposed on said service side of said living unit, said living area and said bedroom area each including windows therein exposed to said protected courtyard, said bathroom, utility room, garage and storage areas forming a buffer for noise and visual pollution between said service side of said living units and said living area and bedroom area, and wherein said garage of each of said living units includes a vehicle entrance therein opening to said service side of said living units and a garage private entrance way from said garage, to said associated living unit.

2. A multi-unit dwelling as defined in claim 1 wherein said plurality of contiguous single floor living units include single floor living units located on not more than two floor levels.

3. A multi-unit dwelling as defined in claim 2 wherein said bathroom, said utility room and said storage areas of each of said units are windowless to improve the buffering of noise and visual pollution between said service side of each of said units and the living area and bedroom area of each of said units.

4. A multi-unit dwelling as defined in claim 2 wherein each living unit further includes a kitchen area interposed between said living area and said service side, said kitchen area acting to further buffer said living area from noise and visual pollution associated with said service side of said living unit.

5. A multi-unit dwelling as defined in claim 2 further including a privacy screen located in said courtyard and extending from the juncture of a pair of adjacent living units which are located on different sides of said courtyard.

6. A multi-unit dwelling as defined in claim 5 wherein, said privacy screen extends at approximately a 45° angle from said pair of adjacent living units which are located on different sides of said courtyard.

7. A multi-unit dwelling as defined in claim 3 wherein said living area includes a living room area and a dining area and said bedroom area includes at least first and second bedrooms, each of said first and second bedrooms including windows therein exposed to said protected courtyard.

8. A multi-unit dwelling as defined in claim 7 wherein each living unit further includes a kitchen area interposed between said living area and said service side, and kitchen area acting to further buffer said living area from noise and visual pollution associated with said service side of said living unit.

9. A multi-unit dwelling as defined in claim 2 wherein said plurality of contiguous living units include living units located on a first floor level and living units located on a second floor level, each of said living units located on a second floor level being located above an associated living unit located on said first floor level.

10. A multi-unit dwelling as defined in claim 9 wherein the garage of each second floor living unit is located on the first floor level contiguous to but physically separated from the garage of the associated living unit located on said first floor level, each of said garages of said second floor living units including a stairway therein from said first floor level garage of said second floor level living unit to said garage private entrance way of said second floor level living unit.

11. A multi-unit dwelling as defined in claim 10 further including an elevator disposed in the garage of said second floor level living units for providing access to said garage private entrance way of said second floor level living unit.

* * * * *